US008723471B2

(12) United States Patent
Van Den Eerenbeemd et al.

(10) Patent No.: US 8,723,471 B2
(45) Date of Patent: May 13, 2014

(54) SYSTEM AND METHOD FOR OPERATING AN EXOSKELETON ADAPTED TO ENCIRCLE AN OBJECT OF INTEREST

(75) Inventors: Jacobus Maria Antonius Van Den Eerenbeemd, Eindhoven (NL); Floris Maria Hermansz Crompvoets, Einhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 173 days.

(21) Appl. No.: 13/318,399

(22) PCT Filed: Apr. 28, 2010

(86) PCT No.: PCT/IB2010/051851

§ 371 (c)(1), (2), (4) Date: Nov. 1, 2011

(87) PCT Pub. No.: WO2010/128429

PCT Pub. Date: Nov. 11, 2010

(65) Prior Publication Data

US 2012/0043920 A1 Feb. 23, 2012

(30) Foreign Application Priority Data

May 5, 2009 (EP) ..... 09159365

(51) Int. Cl.
*G05B 11/01* (2006.01)

(52) U.S. Cl.
USPC ..... 318/560; 318/677; 318/681; 318/685; 318/486; 180/178; 180/268

(58) Field of Classification Search
USPC ..... 318/560, 599, 469, 737, 375, 433, 434, 318/400.04, 727, 677, 681, 685, 486; 388/812; 600/533; 701/42; 360/77.13, 360/77.16; 242/385; 280/806, 807; 180/410–413, 421, 422, 268, 390.8, 180/390.9, 390.1

See application file for complete search history.

(56) References Cited

U.S. PATENT DOCUMENTS

| | | | | |
|---|---|---|---|---|
| 5,659,473 | A * | 8/1997 | Noro et al. | 701/42 |
| 5,716,330 | A * | 2/1998 | Goldman | 601/26 |
| 6,162,183 | A | 12/2000 | Hoover | |
| 6,332,629 | B1 * | 12/2001 | Midorikawa et al. | 280/806 |
| 2002/0077224 | A1 | 6/2002 | Slawinski et al. | |
| 2002/0101210 | A1 * | 8/2002 | Boisvert et al. | 318/469 |
| 2004/0201308 | A1 * | 10/2004 | Kasai | 310/317 |
| 2007/0167855 | A1 * | 7/2007 | Shin et al. | 600/533 |
| 2007/0203433 | A1 | 8/2007 | Murphy | |

* cited by examiner

*Primary Examiner* — Eduardo Colon Santana
*Assistant Examiner* — Jorge L Carrasquillo

(57) ABSTRACT

This invention relates to a servo system for operating an exoskeleton adapted to encircle an object of interest and for supplying a force thereon. A servomotor is coupled to a power source and operates the position of the exoskeleton and thus the force exerted by the exoskeleton on the object of interest. A measuring unit measures a raw driving current signal $I_{raw}$ supplied by the power source to drive the servomotor. A low pass filter applies a low pass frequency filtering on the measured a filtered current signal $I_{filtered}$. A processing unit determines an actuated current signal $I_{actuated}$ based on the servomotor setting parameters, where $I_{actuated}$ indicates the contribution to $I_{raw}$ from the servomotor when operating the position of the exoskeleton. The processing unit also determines a driving force current signal $I_{force}$ indicating the force exerted by the exoskeleton on the object of interest, where $I_{force}$ is proportional to the difference between $I_{filtered}$ and $I_{actuated}$.

20 Claims, 4 Drawing Sheets

SYSTEM AND METHOD FOR OPERATING AN EXOSKELETON ADAPTED TO ENCIRCLE AN OBJECT OF INTEREST

FIELD OF THE INVENTION

The present invention relates to a servo system and a method for operating an exoskeleton adapted to encircle an object of interest and for supplying a force thereon.

BACKGROUND OF THE INVENTION

US20070203433 discloses a wearable relaxation inducing apparatus comprising either a harness or a garment made of elastically flexible fabric tightly worn on the torso. Electromechanical sensors are attached to the fabric for translating the breathing movements of a wearer into electric signals representing breathing rate and depth. Electrically operated transducers are attached to the fabric for providing tactile feedback to the body about breathing and electronic circuitry is used for processing the electrical signals produced by the electromechanical sensors and for operating the transducers at selected adjustable sequences and rates.

Such respiration belts are used to measure the breathing rate of a person. Most belts use gas pressure sensors to measure the change in the expansion and contraction of the chest during breathing. It has been proven that guided breathing is beneficial for (quick) relaxation, which is in turn beneficial for a person's well-being. Currently available respiratory belts only measure the breathing rate, but they do not provide built-in tactile stimulation e.g. feedback to the user on how to breathe.

SUMMARY DESCRIPTION OF THE INVENTION

The object of the present invention is to provide an improved servo system that is capable of sensing respiration and actuation at the same time.

According to a first aspect the present invention relates to a servo system for operating an exoskeleton adapted to surround an object of interest and for supplying a force thereon, comprising:

- a servomotor adapted to operate the position of the exoskeleton and thus the force exerted by the exoskeleton on the object of interest,
- a measuring unit adapted for measuring a raw driving current signal $I_{raw}$ supplied by the power source to drive the servomotor,
- a low pass filtering means adapted to apply a low pass frequency filtering on $I_{raw}$ for determining a filtered current signal $I_{filtered}$, and
- a processing unit adapted to determine:
  - an actuated current signal $I_{actuated}$ based on the servomotor setting parameters, $I_{actuated}$ indicating the contribution to $I_{raw}$ from the servomotor when operating the position of the exoskeleton,
  - a driving force current signal $I_{force}$ indicating the force exerted by the exoskeleton on the object of interest, where $I_{force}$ is proportional to the difference between $I_{filtered}$ and $I_{actuated}$.

It follows that a servo system is provided that can both also act as a force sensor since the force current signal $I_{force}$ indicates the force exerted by the exoskeleton on the object of interest.

In one embodiment, the object of interest is the torso of a user and where the exoskeleton is a belt that encircles the torso, the operation of the position of the belt comprising actuating the encircled length of the belt constant, where $I_{force}$ indicates the force exerted by the belt on the torso.

In one embodiment, the object of interest is the torso of a user and where the exoskeleton is a belt that encircles the torso, the operation of the position comprising maintaining the force exerted by the belt on the torso constant by means of varying the position of the belt, where $I_{force}$ indicates the momentary force exerted by belt on the torso and where the processing unit uses $I_{force}$ as an operation parameter for instructing the servomotor to adjust the position of the belt in accordance to $I_{force}$ such that the resulting force becomes substantial constant. In this manner the belt is 'breathing' along with the user which means that it is not felt by the user. It is namely so that Electrocardiography (ecg) belt are restraining the chest quite a bit and are therefore obtrusive. Accordingly, by knowing the force an operation parameter is provided saying whether the force/current should be increased, decreases or maintained constant, depending on whether the belt is in a fixed position operation mode or fixed force operation mode.

In one embodiment, the processing unit is further adapted to determine the user's respiration based on the frequency of $I_{force}$. After applying said low pass filtering $I_{force}$ shows that the current resulting in either maintaining the force constant or resulting in expanding/retract the belt. Thus, a sinus-wave like current signal is obtained where the frequency of the signal is a clear indicator of the user's respiration.

In one embodiment, the processing unit is further adapted to determine the user's respiration depth based on the amplitude of $I_{force}$. Accordingly, the depth of the resulting $I_{force}$ signal shows the respiration depth and thus how much the user is inhaling/exhaling.

In one embodiment, the exoskeleton is a first and a second ankle brace having a joint there between that is actuated by means of the servomotor, where the servomotor operates the position so as to either allow the joint to freely move or to exert with a force to support the ankle.

In one embodiment, the processing unit determines the force exerted by the exoskeleton on the object of interest from $I_{force}$ based on the amplitude of $I_{force}$ such that the larger the amplitude becomes the larger becomes the force exerted by the exoskeleton on the object of interest.

In one embodiment, the low pass filtering includes a frequency filtering below 500 Hz, more preferably below 50 Hz, more preferably below 50 Hz, more preferably equal or below 1 Hz.

In one embodiment, the $I_{actuator}$ is derived from the servomotor settings. In one embodiment, the servomotor settings include speed, start and stop position of the servomotor where the speed gives the electrical current value, which follows from the motor specification.

According to another aspect, the present invention relates to a method of operating an exoskeleton adapted to embrace an object of interest and for supplying a force thereon by operating the position of the exoskeleton, the method comprising:

- measuring a raw driving current signal $I_{raw}$ supplied by a power source for driving a servomotor to operate the position of the exoskeleton,
- applying a low pass frequency filtering on $I_{raw}$ for determining a filtered current signal $I_{filtered}$, and
- determining an actuated current signal $I_{actuated}$ based on the servomotor setting parameters, $I_{actuated}$ indicating the contribution to $I_{raw}$ from the servomotor when operating the position of the exoskeleton, and determining a driving force current $I_{force}$ indicating the force exerted by the exoskeleton on the object of interest, where $I_{force}$ is proportional to the difference between $I_{filtered}$ and $I_{actuated}$.

According to yet another aspect, the present invention relates to a computer program product for instructing a processing unit to execute the said method steps when the product is run on a computer device.

The aspects of the present invention may each be combined with any of the other aspects. These and other aspects of the invention will be apparent from and elucidated with reference to the embodiments described hereinafter.

BRIEF DESCRIPTION OF THE DRAWINGS

Embodiments of the invention will be described, by way of example only, with reference to the drawings, in which.

DESCRIPTION OF EMBODIMENTS

Figure 1:
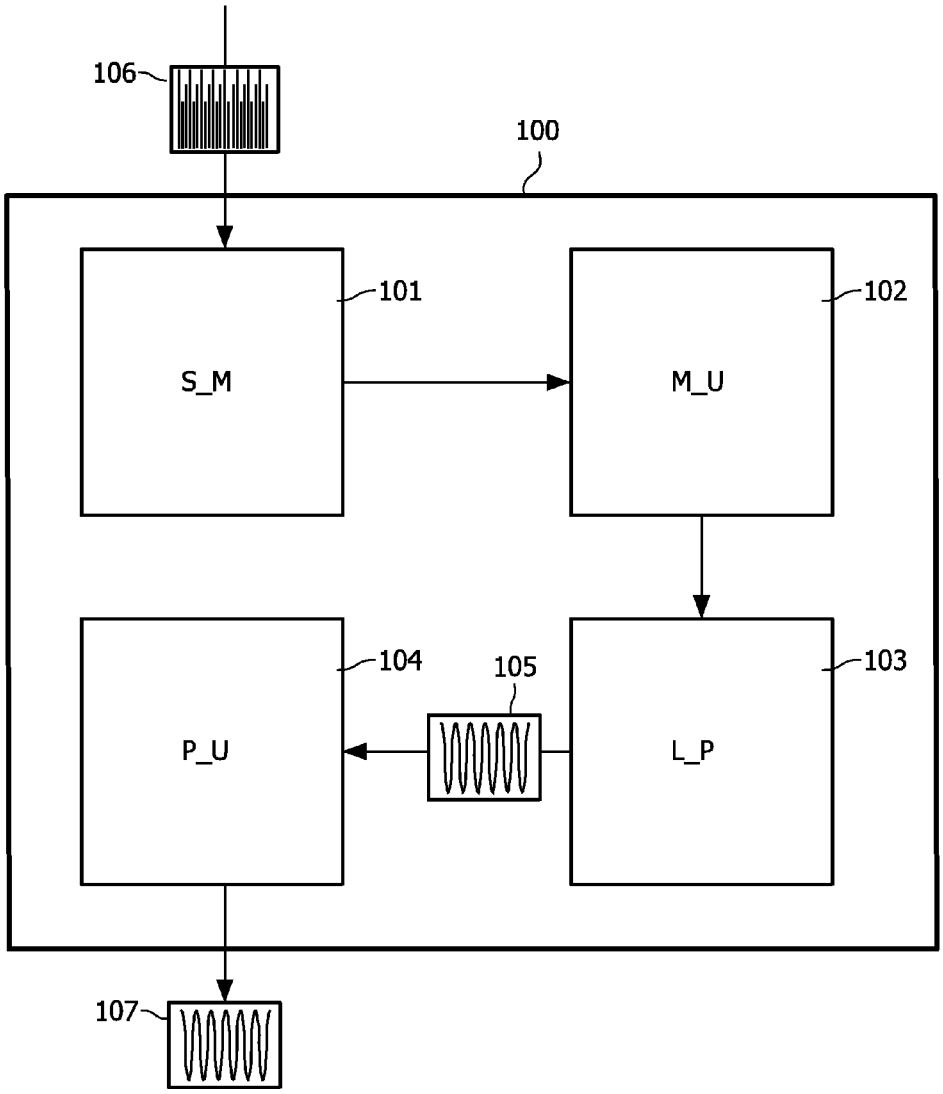
FIG. 1 shows a servo system according to the present invention for operating an exoskeleton adapted to encircle an object of interest and for supplying a force thereon, FIG. 2*a, b* shows an embodiment of the servo system in FIG. 1.

FIG. 1 shows a servo system 100 according to the present invention for operating an exoskeleton adapted to encircle an object of interest and for supplying a force thereon. The servo system 100 comprises a servomotor (S_M) 101, a measuring unit (M_U) 102, a low pass filtering means (L_P) 103 and a processing unit (P_U) 104.

The servomotor (S_M) 101 is connectable to a power source such as a battery or a solar cell and is adapted to operate the position of the exoskeleton and thus the force exerted by the exoskeleton on the object of interest. As will be discussed in more details later in conjunction with FIGS. 2 and 3, the exoskeleton is as an example a belt, an ankle brace and the like, and the object of interest can be the torso of a user or a sprained ankle.

Figure 4:
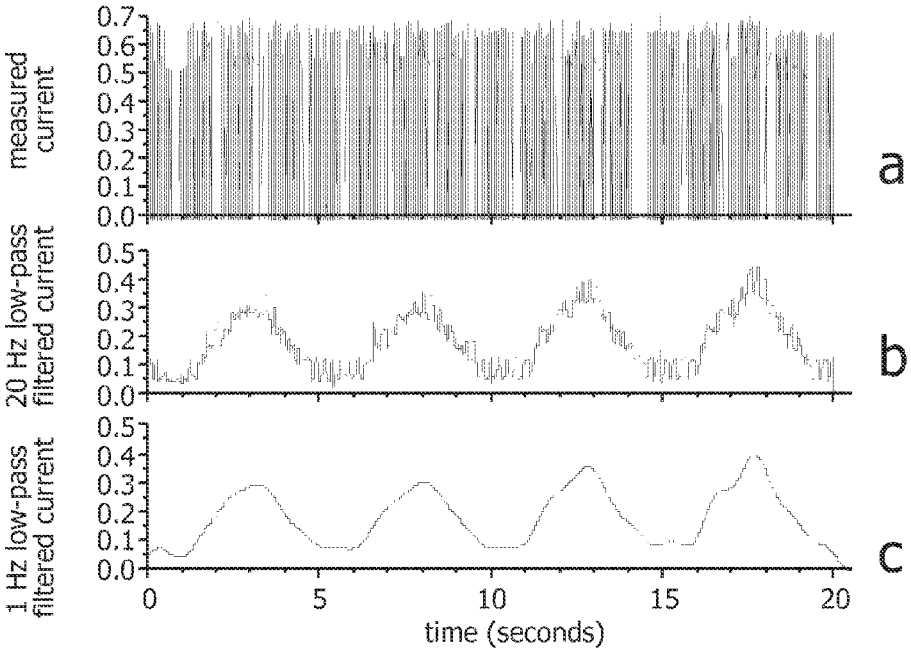
FIG. 4*a-c* shows an example of a measurement of the current through the servo motor on the belt while the motor is kept at a fixed position.

The measuring unit (M_U) 102 is adapted for measuring a raw driving current signal $I_{raw}$ 106 supplied by the power source to drive the servomotor. This will be discussed in more details in conjunction with FIG. 4.

The low pass filtering means (L_P) 103 is as an example a digital or analog circuit or a processor where a low pass frequency filtering is applied on the measured raw driving current signal $I_{raw}$ 106. As will be discussed in more detail in conjunction with FIGS. 4 and 5, the measured raw driving current signal $I_{raw}$ is typically within the kHz range, e.g. about 1 kHz, and the low pass filtering includes a frequency filtering below 500 Hz, more preferably below 50 Hz, more preferably below 50 Hz, more preferably equal or below 1 Hz. The result of the filtering is a filtered current signal $I_{filtered}$ 105.

The processing unit (P_U) 104 is adapted to determine an actuated current signal $I_{actuated}$ based on the servomotor setting parameters, where $I_{actuated}$ indicates the contribution to $I_{raw}$ from the servomotor when operating the position of the exoskeleton.

The processing unit (P_U) 104 is further adapted to determine a driving force current signal $I_{force}$ 107 indicating the force exerted by the exoskeleton on the object of interest, where $I_{force}$ is proportional to the difference between $I_{filtered}$ and $I_{actuated}$, i.e. $I_{force} \sim (I_{filtered} - I_{actuated})$.

In one embodiment, this force is determined based on the amplitude of the force current signal $I_{force}$ 107 such that the larger the amplitude becomes the larger becomes the force exerted by the exoskeleton on the object of interest. This may as an example be done using simple calibration where the actual force is measured for several different force values with an actual force sensor (external force sensor) and compared with the amplitude of the force current signal $I_{force}$ 107.

For further clarification of how of a typical servomotor works, the servomotor may set its position according to a certain encoded signal which is provided by a servo-controller. The encoding is usually done by means of pulse width modulation (PWM) of a square wave signal at a prescribed frequency between 0 Volt and prescribed amplitude such as 5 Volts. At a given PWM the servomotor moves to the corresponding position for which it needs to draw raw driving current signal $I_{raw}$ 106 from its power supply. When the servomotor has reached the position belonging to the PWM-setting it will try to keep it at that position. In this case the raw driving current signal $I_{raw}$ 106 drawn from the power supply will depend directly on the force exerted on the servo. By applying said filtering on the driving current signal $I_{raw}$ 106 $I_{filtered}$ 105 is obtained. If the servomotor is simultaneously used as an actuator then the servomotor changes its position, but this change in the position requires the servomotor to draw additional current. If the position change causes tightening or loosing of the belt the force changes and thereby the $I_{filtered}$. This change of position results in a change in said $I_{actuated}$, which contributes to the $I_{raw}$ 106 and thus to $I_{filtered}$ 105. $I_{actuator}$ can as an example be derived from the actuator settings, namely form speed, start and stop position. The speed gives the electrical current value, which follows from the motor specification. The difference between start and stop position divided by the speed results in the duration of the electrical current increase due to actuation.

Based on the above, by knowing $I_{filtered}$ and $I_{actuated}$ the contribution of the electric current signal due to the force exerted by the exoskeleton on the object of interest may be given by the following equation:

$$I_{_force} = (I_{_filtered} - I_{_actuated})/\mathrm{PWM}, \quad (1)$$

where $I_{_actuated}$ and PWM are both derived form a-priori knowledge on the servo system and the way it is driven. As discussed previously, $I_{_force}$ provides both information about the force exerted by the exoskeleton on the object of interest as well as information about the respiration rate of the subject. In the case where the exoskeleton is kept at constant position $I_{_actuated}$ is zero, whereas in case the servomotor is simultaneously used as an actuator $I_{_actuated}$ is non zero.

Figure 2A:
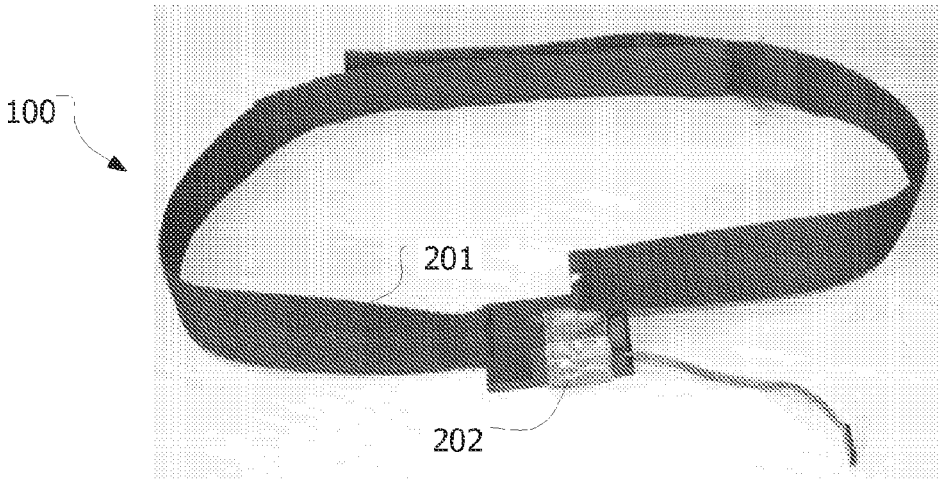
Figure 2B:
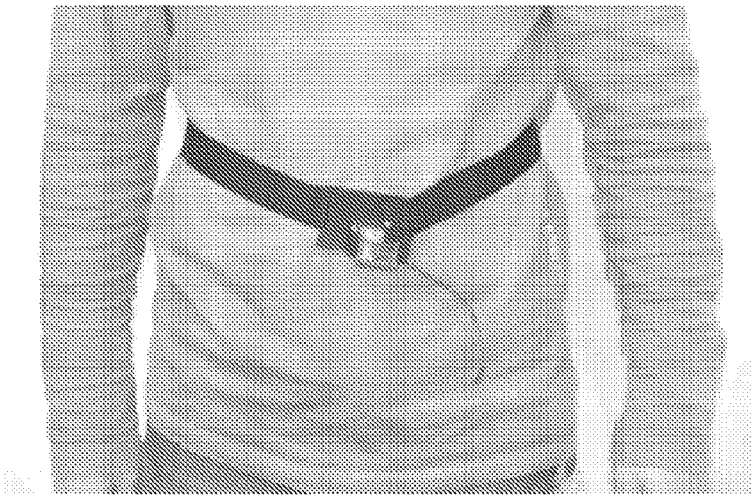

FIG. 2*a,b* shows an embodiment of the servo system 100 in FIG. 1, where the object of interest is the torso 203 of a user 200 and where the exoskeleton is a belt 201 that encircles the torso. There are two measuring options, one is to keep the position of the motor constant, i.e. variable force, and the other one is to keep the force constant (the amplitude of $I_{force}$ constant), where the length of the belt is adjusted accordingly.

When the position of the motor is kept constant the force can be monitored by monitoring $I_{force}$ because the force current signal $I_{force}$ indicates the current drawn from the power supply needed to maintain the position of the belt 201 constant and thus indicates the force exerted by the belt on the belt 201. In this constant position setting the belt may as an example be adjusted such that the maximum current during a breathing cycle is e.g. 70% of the maximum allowable current signal $I_{actuator}$. The frequency of the force current signal $I_{force}$, which typically has a sinus like shape, indicates the user's respiration such that the larger the frequency is the larger is the respiration. Also, the depth of the force current signal $I_{force}$ can be used as an indicator indicating the user's respiration depth and thus how much the user is inhaling/exhaling.

When on the other hand the measuring is based on keeping the amplitude of the force current signal $I_{force}$ constant the belt 201 exerts with a constant force on the user's torso and breathing follows from position. Accordingly, the operation of the position is based on maintaining the force exerted by the belt on the torso constant by means of varying the position of the belt so as to maintain the amplitude of the force current signal $I_{force}$ constant and thus the momentary force exerted by belt on the torso. In that way the servomotor uses $I_{force}$ as an operation parameter by means adjusting the position of the belt in accordance to the $I_{force}$ such that the resulting force becomes substantial constant. This measuring option is less obtrusive and it consumes less power if the electrical current setting is kept low. As an example, let's say that $I_{force}$ (0 sec)=1N, $I_{force}$ (0.2 sec)=1.2N, the belt 201 would be expanded until $I_{force}$ (0.4 sec)=1N. There are of course various time indicators in determining $I_{force}$, e.g. $I_{force}$ could be determined every second, 10 times a second, or more or less than 10 times per second.

Figure 3:
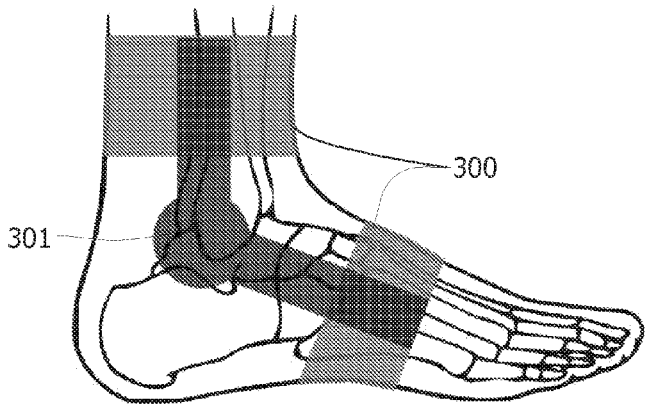
FIG. 3 shows an embodiment where the exoskeleton is a first and a second ankle brace having a joint there between that where the servomotor is located.

FIG. 3 shows an embodiment where the exoskeleton is a first and a second ankle brace 300 having a joint 301 there between that where the servomotor is located, where the joint is actuated by means of the servomotor. Accordingly, the servomotor operates the position so as to either allow the joint to freely move, i.e. $I_{force}$ (the amplitude) is maintained constant, or to exert with a force to support the ankle.

FIG. 4*a-c* shows an example of a measurement of the current through the servo motor on the exoskeleton (belt) while the motor is kept at a fixed position. The raw data $I_{raw}$ are shown in FIG. 4*a* and represents the current driving the servomotor. The pulse width modulation (PWM) driving of the servomotor results in a high frequency signal (about 1 kHz). FIG. 4*b* shows that with 20 Hz low pass filtering on $I_{raw}$ a filtered current signal $I_{filtered}$ is obtained in which the mechanical response of the motor is still visible in the form of oscillations (4-6 Hz). FIG. 4*c* shows that using a 1 Hz low pass filter a clearer $I_{filtered}$ signal is obtained. Since this example applies for the scenario where the position of the exoskeleton is fixed, $I_{actuated}$ is zero (see equation 1). Therefore, $I_{filtered}$ corresponds to $I_{force}$. This clean $I_{filtered}$ ($I_{force}$) gives thus a very clean respiration signal of the user of the exoskeleton (e.g. belt). As discussed previously, an increasing amplitude of the force current signal $I_{force}$ corresponds to inhaling, while a decreasing current corresponds to exhaling. As shown, it is due to the large difference between the PWM frequency and the frequency of interest that this severe filtering is applicable.

Figure 5:
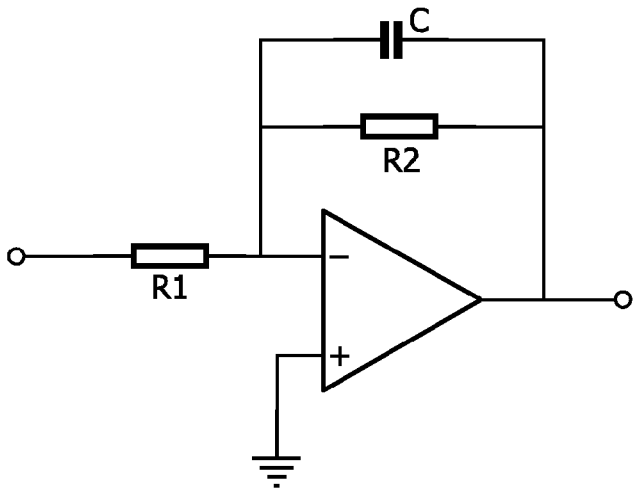
FIG. 5 depicts one embodiment of a filtering circuit for applying a low pass frequency filtering on the measured raw driving current signal $I_{raw}$.

FIG. 5 depicts one embodiment of a filtering circuit. The driving raw current signal $I_{raw}$ can occur in either the analog or the digital domain. This low pass filter may operate using a cut-off frequency of $\omega_0=1/(R2\times C)$. Analog filtering can be achieved by means of a simple RC-network or as an active filter as shown here. In the digital domain one needs to sample the signal at a frequency of preferably at least twice the frequency of the signal of interest (Nyquist frequency). In this embodiment a sampling rate of a few Hz which is much smaller than the PWM frequency (~kHz). By sampling at a somewhat higher frequency (e.g. a couple of tens of Hz, still well below PWM frequency) and applying a running average to the sampled values the signal becomes smoother (see FIG. 4).

Figure 6:
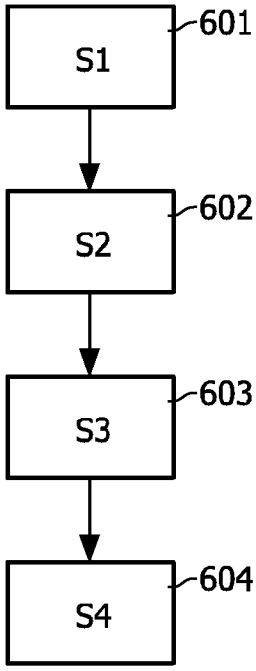
FIG. 6 is a flowchart of an embodiment of a method according to the present invention of operating an exoskeleton adapted to encircle an object of interest.

FIG. 6 shows a flowchart of an embodiment of a method according to the present invention of operating an exoskeleton adapted to encircle an object of interest and for supplying a force thereon where a servomotor is coupled to a power source adapted to operate the position of the exoskeleton and thus the force exerted by the exoskeleton on the object of interest.

In step (S1) 601, a raw driving current signal $I_{raw}$ supplied by the power source to drive the servomotor is measured, in step (S2) 602, a low pass frequency filtering on $I_{raw}$ for determining a filtered current signal $I_{filtered}$ applied, in step (S3) 603, an actuated current signal $I_{actuated}$ is determined based on the servomotor setting parameters, $I_{actuated}$ indicating the contribution to $I_{raw}$ from the servomotor when operating the position of the exoskeleton, and in step (S4) 604 a driving force current $I_{force}$ is determined indicating the force exerted by the is exoskeleton on the object of interest, where $I_{force}$ is proportional to the difference between $I_{filtered}$ and $I_{actuated}$. For further clarification of each respective step, a reference is made to the previous discussion under FIGS. 1-5.

Certain specific details of the disclosed embodiment are set forth for purposes of explanation rather than limitation, so as to provide a clear and thorough understanding of the present invention. However, it should be understood by those skilled in this art, that the present invention might be practiced in other embodiments that do not conform exactly to the details set forth herein, without departing significantly from the spirit and scope of this disclosure. Further, in this context, and for the purposes of brevity and clarity, detailed descriptions of well-known apparatuses, circuits and methodologies have been omitted so as to avoid unnecessary detail and possible confusion.

Reference signs are included in the claims, however the inclusion of the reference signs is only for clarity reasons and should not be construed as limiting the scope of the claims.

The invention claimed is:

1. A servo system for operating an exoskeleton dimensioned to surround an object of interest and for supplying a force thereon, comprising:

a servomotor adapted to operate the position of the exoskeleton and thus the force exerted by the exoskeleton on a plurality of locations of the object of interest, wherein the plurality of locations surround the object of interest, a measuring unit adapted for measuring a raw driving current signal $I_{new}$ supplied by a power source for driving the servomotor, a low pass filtering means adapted to apply a low pass frequency filtering on $I_{raw}$ for determining a filtered current signal $I_{filtered}$, and a processing unit adapted to determine:

an actuated current signal $I_{actuated}$ based on servomotor setting parameters, $I_{actuated}$ indicating the contribution to $I_{raw}$ from the servomotor when operating the position of the exoskeleton, and a driving force current signal $I_{force}$ indicating the force exerted by the exoskeleton on the object of interest, where $I_{force}$ is proportional to the difference between $I_{filtered}$ and $I_{actuated}$.

2. A servo system according to claim 1, wherein the object of interest is the torso of a user and where the exoskeleton is a belt that encircles the torso, the operation of the position of the belt comprising actuating the encircled length of the belt constant, where $I_{force}$ indicates the force exerted by the belt on the torso.

3. A servo system according to claim 1, wherein the object of interest is the torso of a user and where the exoskeleton is a belt that encircles the torso, the operation of the position comprising maintaining the force exerted by the belt on the torso constant by means of varying the position of the belt, where $I_{force}$ indicates the momentary force exerted by the belt on the torso and where the processing unit uses $I_{force}$ as an operation parameter for instructing the servomotor to adjust the position of the belt in accordance to $I_{force}$ such that the resulting force becomes substantial constant.

4. A servo system according to claim 1, wherein the processing unit is further adapted to determine the user's respiration based on the frequency of $I_{force}$.

5. A servo system according to claim 1, wherein the processing unit is further adapted to determine the user's respiration depth based on the amplitude of $I_{force}$.

6. A servo system according to claim 1, wherein the exoskeleton is a first and a second ankle brace having a joint there between that is actuated by means of the servomotor, where the servomotor operates the position so as to either allow the joint to freely move or to exert with a force to support the ankle.

7. A servo system according to claim 1, wherein the processing unit determines the force exerted by the exoskeleton on the object of interest from $I_{force}$ based on the amplitude of $I_{force}$ such that the larger the amplitude becomes the larger becomes the force exerted by the exoskeleton on the object of interest.

8. A servo system according to claim 1, wherein the low pass filtering includes a frequency filtering below 500 Hz.

9. A servo system according to claim 1, wherein $I_{actuator}$ is derived from the servomotor settings.

10. A servo system according to claim 9, wherein the servomotor settings include speed, start and stop position of the servomotor where the speed gives the electrical current value, which follows from the motor specification.

11. A servo system according to claim 1, wherein the low pass filtering includes a frequency filtering below 50 Hz.

12. A servo system according to claim 1, wherein the low pass filtering includes a frequency filtering equal or below 1 Hz.

13. A method of operating an exoskeleton dimensioned to surround an object of interest and for supplying a force thereon, where a servomotor is adapted to operate the position of the exoskeleton, the method comprising:

measuring a raw driving current signal $I_{raw}$ supplied by a power source for driving the servomotor, applying a low pass frequency filtering on $I_{raw}$ for determining a filtered current signal $I_{filtered}$, determining an actuated current signal $I_{actuated}$ based on the servomotor setting parameters, $I_{actuated}$ indicating the contribution to $I_{raw}$ from the servomotor when operating the position of the exoskeleton, and determining a driving force current $I_{force}$ indicating the force exerted by the exoskeleton on a plurality of locations of the object of interest, where $I_{force}$ is proportional to the difference between $I_{filtered}$ and $I_{actuated}$, wherein the plurality of locations surround the object of interest.

14. A non-transitory computer readable medium encoded with a computer program having a set of instructions for instructing a processing unit to execute a method when the computer program is run on a computer device, said method operates an exoskeleton dimensioned to surround an object of interest and for supplying a force thereon, where a servomotor is adapted to operate the position of the exoskeleton, the method comprising:

measuring a raw driving current signal $I_{raw}$ supplied by a power source for driving the servomotor, applying a low pass frequency filtering on $I_{raw}$ for determining a filtered current signal $I_{filtered}$, determinina an actuated current signal $I_{actuated}$ based on the servomotor setting parameters, $I_{actuated}$ indicating the contribution to $I_{raw}$ from the servomotor when operating the position of the exoskeleton, and determining a driving force current $I_{force}$ indicating the force exerted by the exoskeleton on a plurality of locations of the object of interest, where $I_{force}$ is proportional to the difference between $I_{filtered}$ and $I_{actuated}$, wherein the plurality of locations surround the object of interest.

15. A servo system for operating an exoskeleton adapted to surround an object of interest and for supplying a force thereon, comprising:

a servomotor adapted to operate the position of the exoskeleton and thus the force exerted by the exoskeleton on the object of interest, a measuring unit adapted for measuring a raw driving current signal $I_{raw}$ supplied by a power source for driving the servomotor, a low pass filtering means adapted to apply a low pass frequency filtering on $I_{raw}$ for determining a filtered current signal $I_{filtered}$, and a processing unit adapted to determine:

an actuated current signal $I_{actuated}$ based on servomotor setting parameters, $I_{actuated}$ indicating the contribution to $I_{raw}$ from the servomotor when operating the position of the exoskeleton, a driving force current signal $I_{force}$ indicating the force exerted by the exoskeleton on the object of interest, where $I_{force}$ is proportional to the difference between $I_{filtered}$ and $I_{actuated}$, wherein the object of interest is the torso of a user and where the exoskeleton is a belt that encircles the torso, the operation of the position of the belt comprising actuating the encircled length of the belt constant, where $I_{force}$ indicates the force exerted by the belt on the torso.

16. A servo system for operating an exoskeleton adapted to surround an object of interest and for supplying a force thereon, comprising:

a servomotor adapted to operate the position of the exoskeleton and thus the force exerted by the exoskeleton on the object of interest, a measuring unit adapted for measuring a raw driving current signal $I_{raw}$ supplied by a power source for driving the servomotor, a low pass filtering means adapted to apply a low pass frequency filtering on $I_{raw}$ for determining a filtered current signal $I_{filtered}$, and a processing unit adapted to determine:

an actuated current signal $I_{actuated}$ based on servomotor setting parameters, $I_{actuated}$ indicating the contribution to $I_{Raw}$ from the servomotor when operating the position of the exoskeleton, a driving force current signal $I_{force}$ indicating the force exerted by the exoskeleton on the object of interest, where $I_{force}$ is proportional to the difference between $I_{filtered}$ and $I_{actuated}$, wherein the object of interest is the torso of a user and where the exoskeleton is a belt that encircles the torso, the operation of the position comprising maintaining the force exerted by the belt on the torso constant by means of varying the position of the belt, where $I_{force}$ indicates the momentary force exerted by the belt on the torso and where the processing unit uses $I_{force}$ as an operation parameter for instructing the servomotor to adjust the position of the belt in accordance to $I_{force}$ such that the resulting force becomes substantial constant.

17. A servo system for operating an exoskeleton adapted to surround an object of interest and for supplying a force thereon, comprising:

a servomotor adapted to operate the position of the exoskeleton and thus the force exerted by the exoskeleton on the object of interest, a measuring unit adapted for measuring a raw driving current signal $I_{raw}$ supplied by a power source for driving the servomotor, a low pass filtering means adapted to apply a low pass frequency filtering on $I_{raw}$ for determining a filtered current signal $I_{filtered}$, and a processing unit adapted to determine:

an actuated current signal $I_{actuated}$ based on servomotor setting parameters, $I_{actuated}$ indicating the contribution to $I_{raw}$ from the servomotor when operating the position of the exoskeleton, a driving force current signal $I_{force}$ indicating the force exerted by the exoskeleton on the object of interest, where $I_{force}$ is proportional to the difference between $I_{filtered}$ and $I_{actuated}$, wherein the processing unit is further adapted to determine the user's respiration based on the frequency of $I_{force}$.

18. A servo system for operating an exoskeleton adapted to surround an object of interest and for supplying a force thereon, comprising:

a servomotor adapted to operate the position of the exoskeleton and thus the force exerted by the exoskeleton on the object of interest, a measuring unit adapted for measuring a raw driving current signal $I_{raw}$ supplied by a power source for driving the servomotor, a low pass filtering means adapted to apply a low pass frequency filtering on $I_{raw}$ for determining a filtered current signal $I_{filtered}$, and a processing unit adapted to determine:

an actuated current signal $I_{actuated}$ based on servomotor setting parameters, $I_{actuated}$ indicating the contribution to $I_{raw}$ from the servomotor when operating the position of the exoskeleton, a driving force current signal $I_{force}$ indicating the force exerted by the exoskeleton on the object of interest, where $I_{force}$ is proportional to the difference between $I_{filtered}$ and $I_{actuated}$, wherein the processing unit is further adapted to determine the user's respiration depth based on the amplitude of $I_{force}$.

19. A servo system for operating an exoskeleton adapted to surround an object of interest and for supplying a force thereon, comprising:

a servomotor adapted to operate the position of the exoskeleton and thus the force exerted by the exoskeleton on the object of interest, a measuring unit adapted for measuring a raw driving current signal $I_{raw}$ supplied by a power source for driving the servomotor, a low pass filtering means adapted to apply a low pass frequency filtering on $I_{raw}$ for determining a filtered current signal $I_{filtered}$, and a processing unit adapted to determine:

an actuated current signal $I_{actuated}$ based on servomotor setting parameters, $I_{actuated}$ indicating the contribution to $I_{raw}$ from the servomotor when operating the position of the exoskeleton, a driving force current signal $I_{force}$ indicating the force exerted by the exoskeleton on the object of interest, where $I_{force}$ is proportional to the difference between $I_{filtered}$ and $I_{actuated}$, wherein the exoskeleton is a first and a second ankle brace having a joint there between that is actuated by means of the servomotor, where the servomotor operates the position so as to either allow the joint to freely move or to exert with a force to support the ankle.

20. The servo system according to claim 19, wherein the processing unit determines the force exerted by the exoskeleton on the object of interest from $I_{force}$ based on the amplitude of $I_{force}$ such that the larger the amplitude becomes the larger becomes the force exerted by the exoskeleton on the object of interest.

* * * * *